US007610704B1

(12) United States Patent
Nowicki

(10) Patent No.: US 7,610,704 B1
(45) Date of Patent: Nov. 3, 2009

(54) DISPLAY STRUCTURE WITH MOVING ATTRACTION ELEMENTS

(76) Inventor: Michael J. Nowicki, 1150 Rock Rd., Marathon, WI (US) 54448

( * ) Notice: Subject to any disclaimer, the term of this patent is extended or adjusted under 35 U.S.C. 154(b) by 299 days.

(21) Appl. No.: 11/646,084

(22) Filed: Dec. 27, 2006

(51) Int. Cl.
*G09F 19/00* (2006.01)

(52) U.S. Cl. ..... 40/435; 40/429; 40/430

(58) Field of Classification Search ..... 40/435, 40/430, 432, 499, 506, 518
See application file for complete search history.

(56) References Cited

U.S. PATENT DOCUMENTS 1,374,921 A * 4/1921 Houston ..... 40/430
2,791,048 A * 5/1957 Caller ..... 40/500
3,475,845 A * 11/1969 Estvan, Jr. ..... 40/430
3,897,054 A * 7/1975 Riggs ..... 472/6
3,919,795 A * 11/1975 Van Horne Jinivisian et al. ..... 40/473
4,099,340 A * 7/1978 Butler ..... 434/300
4,461,106 A * 7/1984 Lawson ..... 40/505
4,888,892 A * 12/1989 Ortega ..... 40/430
6,148,552 A * 11/2000 Dumontier et al. ..... 40/473
7,121,026 B2 * 10/2006 Chen ..... 40/504
2002/0026733 A1 * 3/2002 Cutright ..... 40/430
2003/0131509 A1 * 7/2003 Lanci ..... 40/455
2003/0142497 A1 * 7/2003 Wu ..... 362/352

* cited by examiner

*Primary Examiner*—Paul N Dickson
*Assistant Examiner*—Christopher E Veraa
(74) *Attorney, Agent, or Firm*—William E. Hein

(57) ABSTRACT

A tension fabric display structure incorporates segmented tubular framework permitting easy on-site assembly and disassembly and includes an integral drive motor coupled to a drive shaft that is supported for rotation within a framework tube. Each one of a plurality of attraction elements suspended from the framework tube housing the drive shaft is rotationally driven by a coupling assembly connected to the drive shaft.

15 Claims, 8 Drawing Sheets

DISPLAY STRUCTURE WITH MOVING ATTRACTION ELEMENTS

BACKGROUND AND SUMMARY OF THE INVENTION

This invention relates generally to exhibit and display structures of the type used at trade shows and other similar events and, more particularly, to such a structure that includes moving attraction elements to more effectively draw the attention of show attendees. Exhibit and display structures are important marketing tools used in connection with trade shows, point of purchase locations, billboard and sign advertising, for example. Their primary purpose is to attract potential customers of the products being advertised. Various techniques have been employed to enhance the attractiveness of these displays, including vertical presence, striking color effects, lighting, and motion. The use of motion is presently limited to simple rotation of larger hanging structures or ground-based rotation of an entire structure. However, many exhibit halls do not permit display structures to be hung from the ceilings.

The current industry trend is toward the use of display structures that employ a thin wall aluminum tubing frame with a tension fabric covering. These structures have the advantage of light weight and compact shipping size, when unassembled. At the same time, they are relatively large when assembled. Representative of the use of tension fabric is U.S. Pat. No. 4,036,244 to Huddle, directed to an enclosure utilizing arch supports covered with a flexible membrane. U.S. Pat. Nos. 5,345,962, 5,441,069, and 5,477,875 to Moss teach fabric structures with a pavilion style of construction. Among the present U.S. manufacturers of tension fabric exhibit and display structures are Moss, Inc., Skyline Displays, Inc., Nimlock, and Tencat Productions, LLC, for example.

It would be advantageous to provide distributed, synchronized motion to exhibit, display, and other marketing structures that may be easily assembled, disassembled, and transported. In accordance with one embodiment of the present invention, a banging display structure includes segmented upper and lower horizontal circular support tubes and a tension fabric membrane attached in the vertical space between the support tubes. Openings in the fabric membrane permit placement therein of attraction elements supported for rotation from the upper support tube. A drive ring is supported for rotation within the upper support tube. Rotational motion is coupled from a drive motor to the drive ring by way of a miter gear coupling tee assembly and is, in turn, coupled from the drive ring to each of the attraction elements by way of another miter gear coupling tee assembly. In accordance with another embodiment of the present invention, a free-standing tension fabric display structure includes a base and a plurality of segmented upwardly and outwardly extending support tubes and a horizontally-positioned upper circular support tube attached to the top ends thereof. A drive motor is positioned within the base in axial alignment with one of the upwardly and outwardly extending support tubes. A first drive shaft is supported for rotation within that one of the upwardly and outwardly extending support tubes and is coupled to a second drive shaft supported for rotation within the upper circular support tube by way of a miter gear coupling tee assembly. A plurality of attraction elements, depending from the upper circular support tube are driven by way of a miter gear coupling tee assembly connecting each of them to the second drive shaft.

DESCRIPTION OF THE PREFERRED EMBODIMENTS

Figure 1:
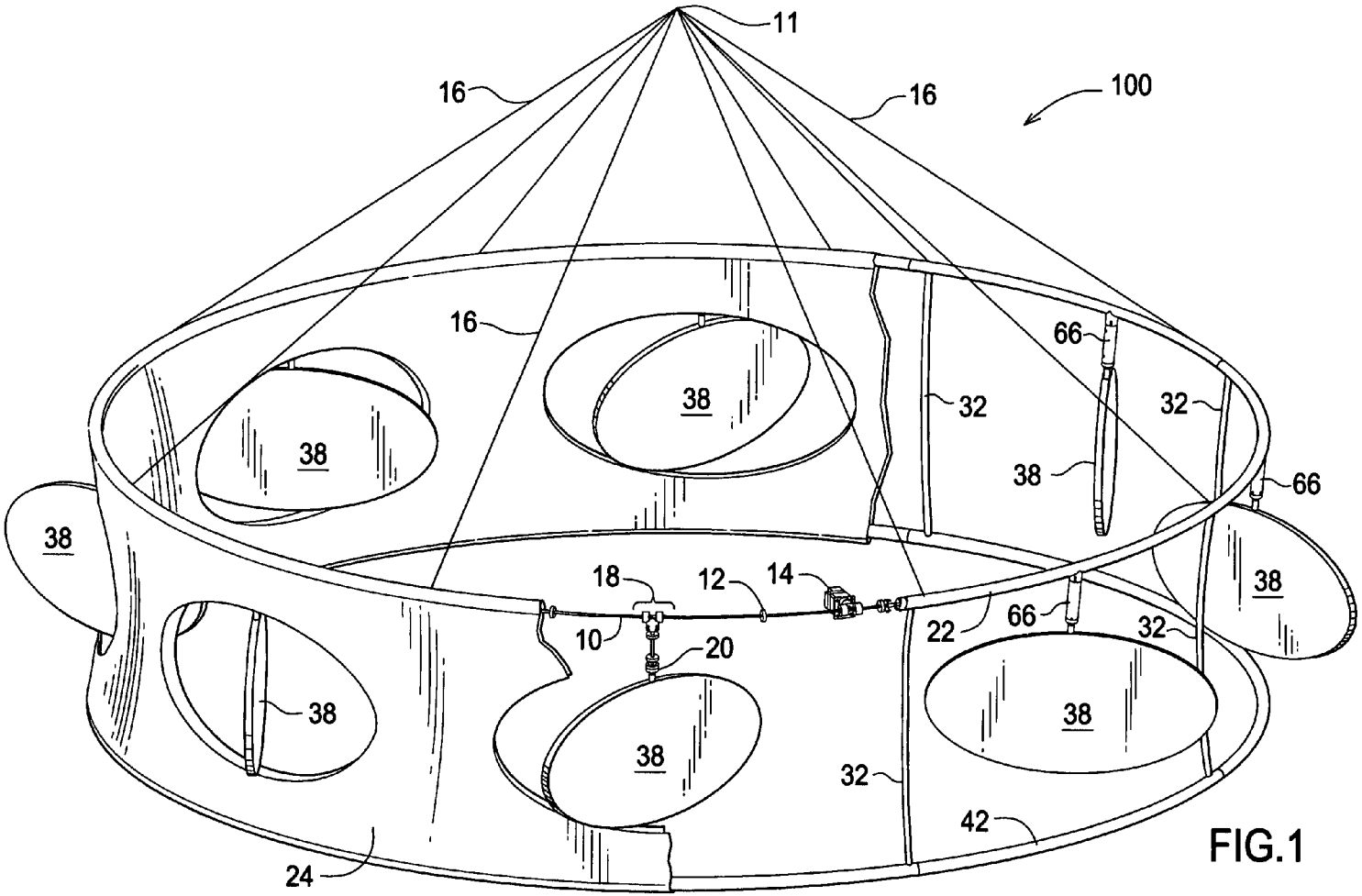
FIG. 1 is a pictorial diagram of a hanging tension fabric display structure that employs a plurality of rotationally driven attraction elements, in accordance with a first embodiment of the present invention.

Referring now to FIG. 1, there is shown a ring banner type of hanging tension fabric display structure 100 adapted to be hung from above at an attachment point 11 by means of a plurality of cables 16. The framework of display structure 100 includes an upper horizontal circular support tube 22, a lower horizontal circular support tube 42, parallel thereto, and a plurality of spaced apart vertical support members 32. Support tubes 22, 42 may be constructed of abutting arcuate sections of any conventional, commercially available material such as aluminum or plastic, for example. A conventional tension fabric membrane 24 generally covers the vertical space between the support tubes 22, 42. A plurality of openings in fabric membrane 24 reveal a like plurality of attraction elements 38 that are suspended for rotation from support tube 22 within the openings. While the attraction elements 38 and their corresponding openings in fabric membrane 24 are shown to be elliptical in shape, they may chosen to be of any other geometric shape or combination of shapes.

Figure 2:
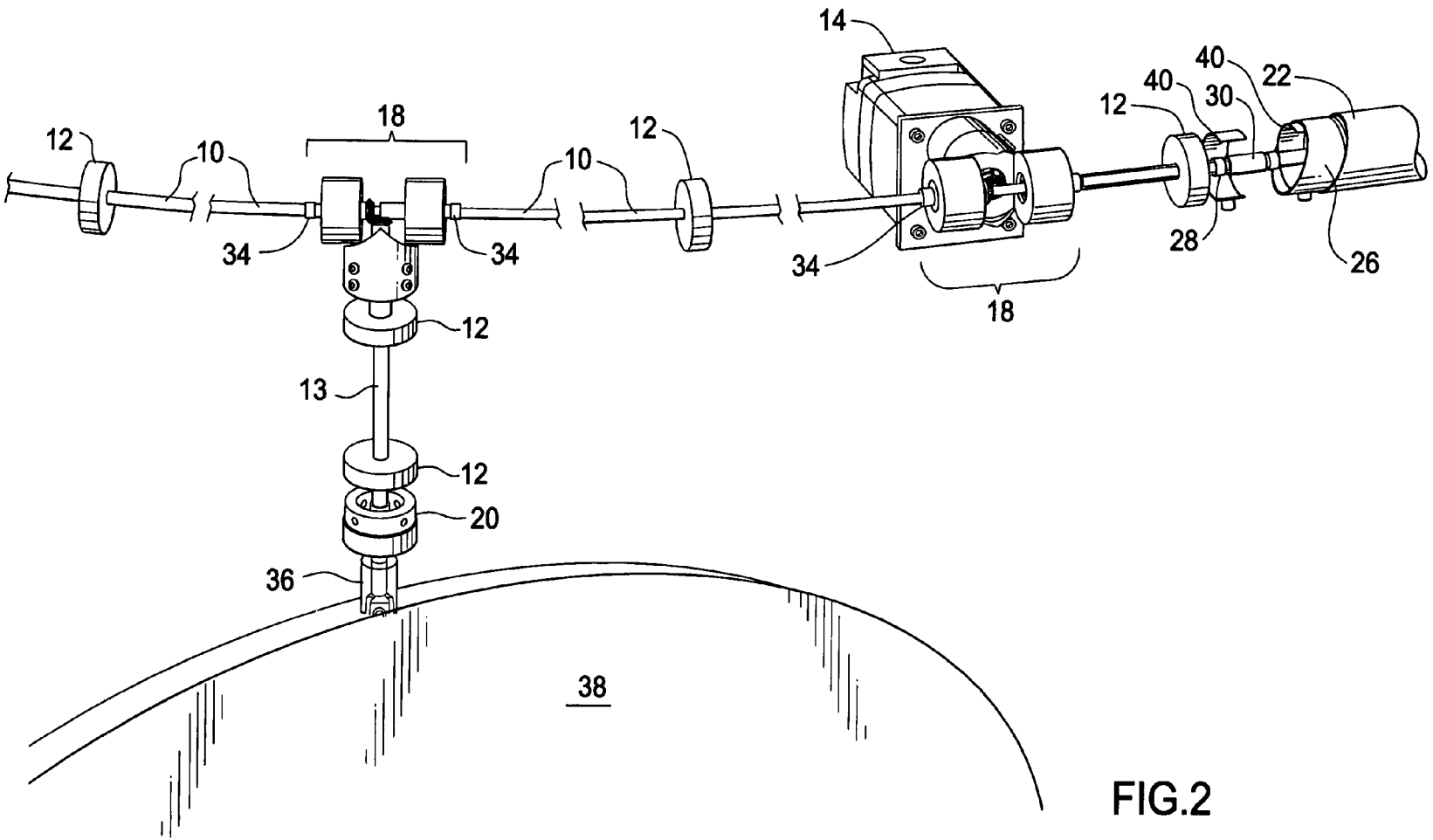
FIG. 2 is a detailed pictorial diagram illustrating the way in which one of the attraction elements of the display structure of FIG. 1 is rotationally driven.
Figure 3:
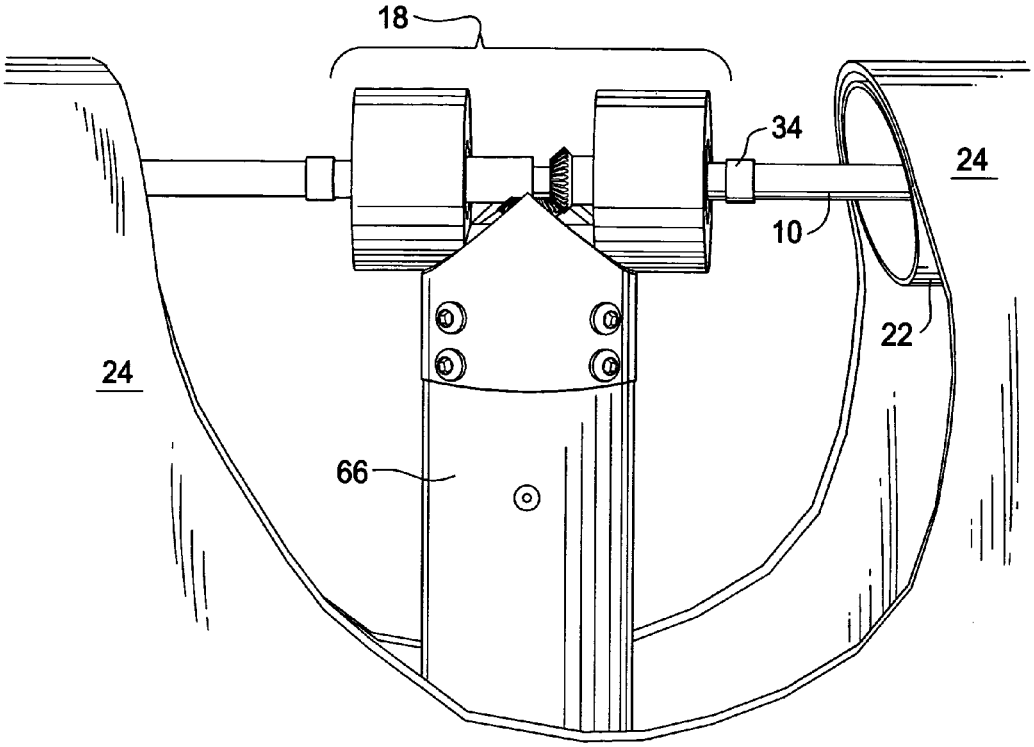
FIG. 3 is a detailed pictorial diagram of the miter gear coupling tee assembly shown in FIGS. 1 and 2.
Figure 4:
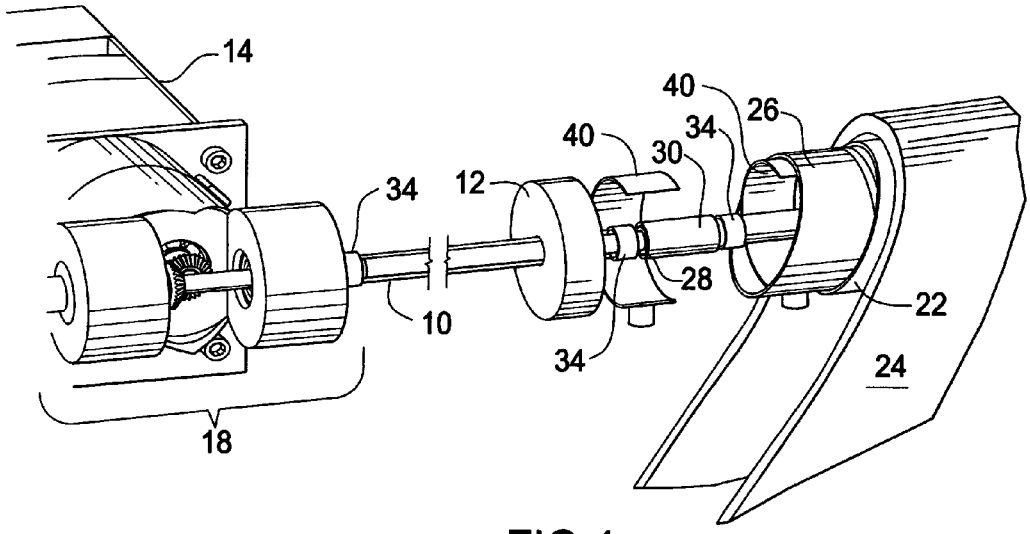
FIG. 4 is a detailed pictorial diagram of the motor and drive shaft coupler of FIG. 2.

Referring additionally to FIGS. 2-4, there are shown the details of the cutaway portion of the drive train of FIG. 1 that serve to impart rotational motion to all of the attraction elements 38. A single drive motor 14 supplies rotational motion to a flexible drive ring 10 that is generally coaxially positioned within support tube 22. Drive ring 10 may be constructed of lengths of cross-linked polyethylene tubing (PEX) of the type readily commercially available. Mating coupler members 28, 30 between each of the lengths of tubing that form drive ring 10 allow for axial movement of drive ring 10 while preserving the transfer of rotational motion from one length of tubing to the next. The points of abutment between the arcuate lengths of tubing that form support tube 22 are positioned to coincide with the points of connection between each of the lengths of tubing that form drive ring 10. The lengths of tubing that form both support tubes 22, 42 are maintained in alignment at their abutting ends by means of a short length of tubing 26 sized to fit inside thereof. A pair of C-shaped snap buttons 40 serve to secure the short length of tubing 26 within the abutting lengths of tubing that form support tubes 22, 42, while allowing them to be quickly and easily dissembled for transport.

Figure 9:
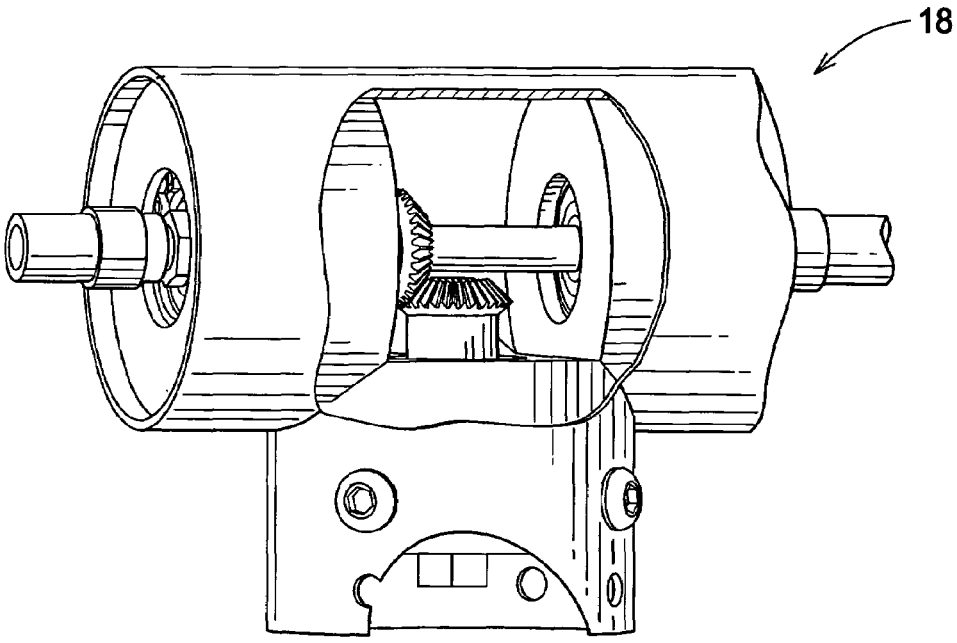
FIG. 9 is a detailed cutaway pictorial diagram of the miter gear coupling tee assembly shown in FIGS. 1-3 and 7.

Drive ring 10 is axially supported for rotation within support tube 22 by a plurality of circular discs 12 that are spaced a desired distance from each other inside support tube 22 and attached thereto by rivets or other conventional attachment means. The discs 12 are fabricated of nylon or other material exhibiting a low coefficient of friction and have a central hole therein for receiving drive ring 10 with ample clearance for permitting free rotation thereof. The output shaft of drive motor 14 is coupled to drive ring 10 by means of a miter gear coupling tee assembly 18 that may be conventionally constructed in accordance with the detailed illustrations of FIGS. 3 and 9. Each of the attraction elements 38 is similarly separately rotationally driven by one of the miter gear coupling tees 18 connected to drive ring 10. A drive shaft 13, constructed of the same material as drive ring 10, connects each of the attraction elements 38 to a coupling tee 18, as illustrated in FIG. 2. A carrier assembly 20 supports the weight of each of the attraction elements 38 and transfers that weight to support tube 22 to thereby eliminate any axial load on drive shaft 13 and the gear drive mechanism of coupling tee 18. A section of tubing 66, illustrated generally in FIG. 1 and in detail in FIG. 3, of the type from which support tubes 22, 42 are formed, is attached to carrier assembly 20 and the housing of coupling tee 18 and covers the upper portion of drive shaft 13 and the circular discs 12 installed thereon. The lower end of drive shaft 13 is secured by a clamp 36 that is attached to attraction element 38.

Figure 5:
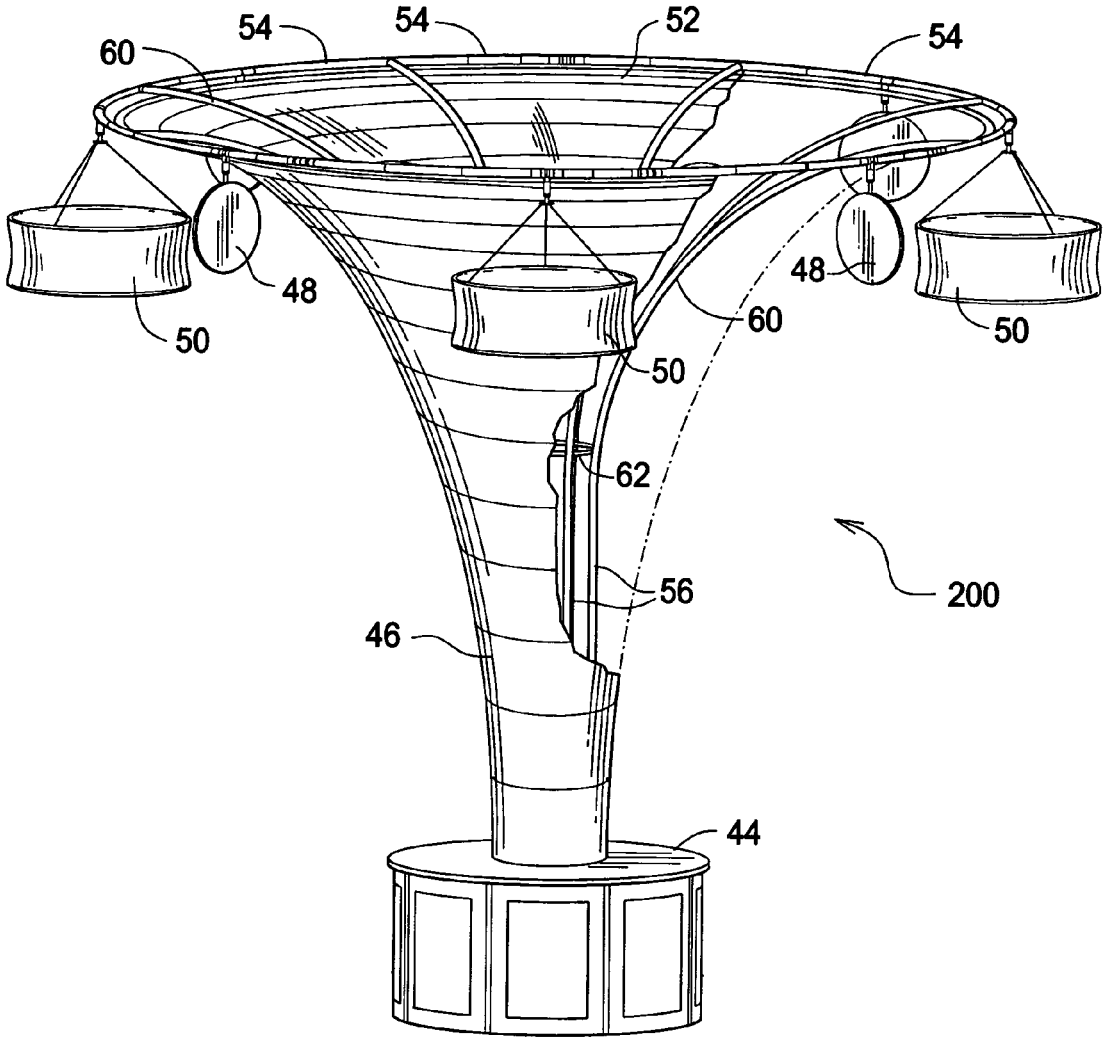
FIG. 5 is a pictorial diagram of a free-standing tension fabric display structure that employs a plurality of rotationally driven elements, in accordance with a second embodiment of the present invention.
Figure 6:
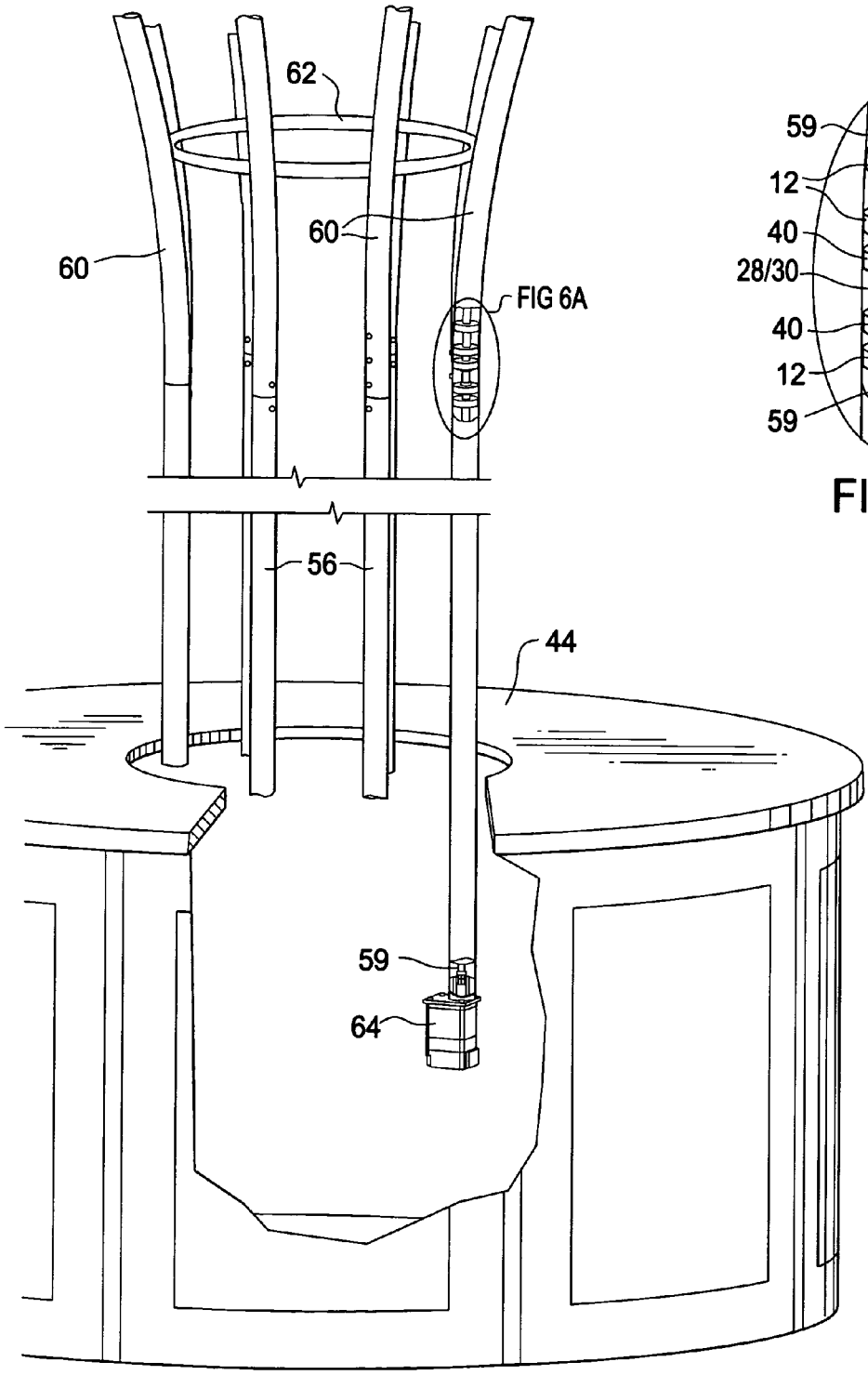
FIG. 6 is a detailed pictorial diagram of a base portion of the display structure of FIG. 5, illustrating how a drive motor and a drive shaft coupled thereto may be located.
Figure 6A:
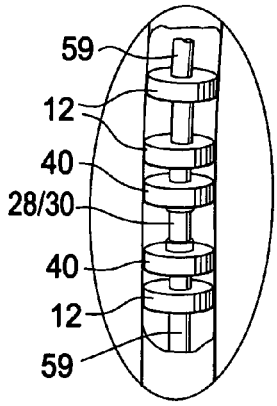

Referring now to FIGS. 5, 6, and 6A, there is shown a second embodiment of the present invention in the form of a free-standing tension fabric display structure 200. Display structure 200 includes a base 44 that may be constructed of wood, plywood, and laminates, as is typical in the display industry. The framework of display structure 200 includes a plurality of straight support tubes 56 arranged vertically in a circle. A like plurality of outwardly-curved support tubes 60 are attached in abutting relationship to the top end of each of the straight support tubes 56. Attached at the top end of each of the outwardly-curved support tubes 60 is a horizontal circular support tube 54, constructed in the same way as horizontal support tubes 22, 42 of FIG. 1. One or more additional horizontal circular support tubes 52, 62 may be attached to curved support tubes 60 below support tube 54 to provide extra structural support. A tension fabric membrane 46, like that of fabric membrane 24 of FIG. 1, is stretched between base 44 and support tube 52 outside of support tubes 56, 60 to define an upwardly and outwardly extending conical fabric form.

Figure 7:
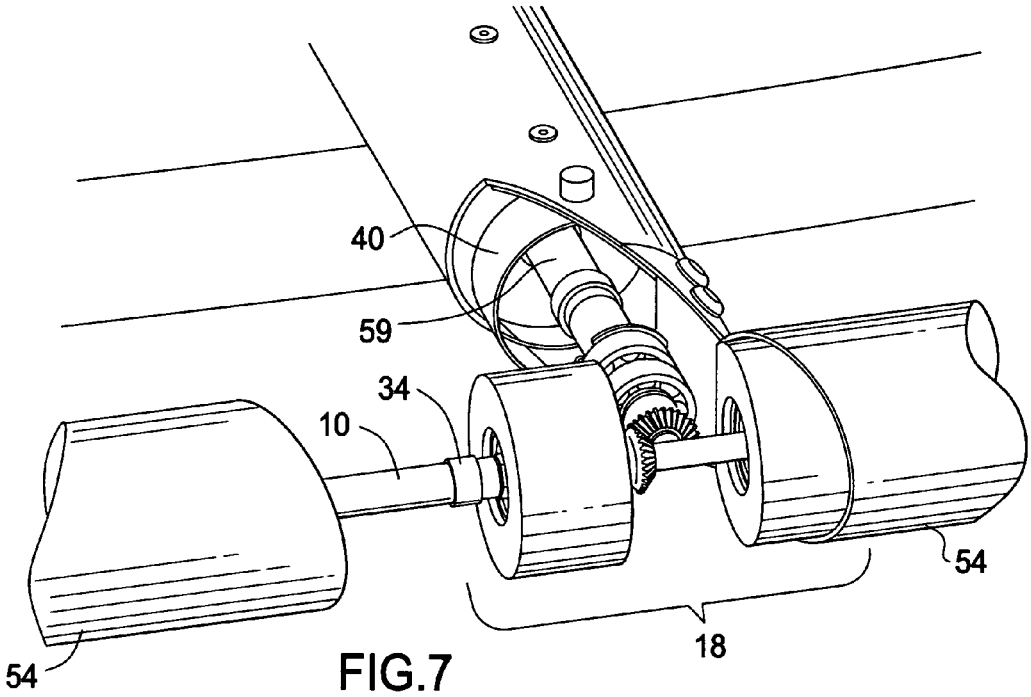
FIG. 7 is a detailed pictorial diagram of a miter gear coupling tee assembly illustrating how rotational motion is coupled into the upper ring drive train of the display structure of FIG. 5.
Figure 8:
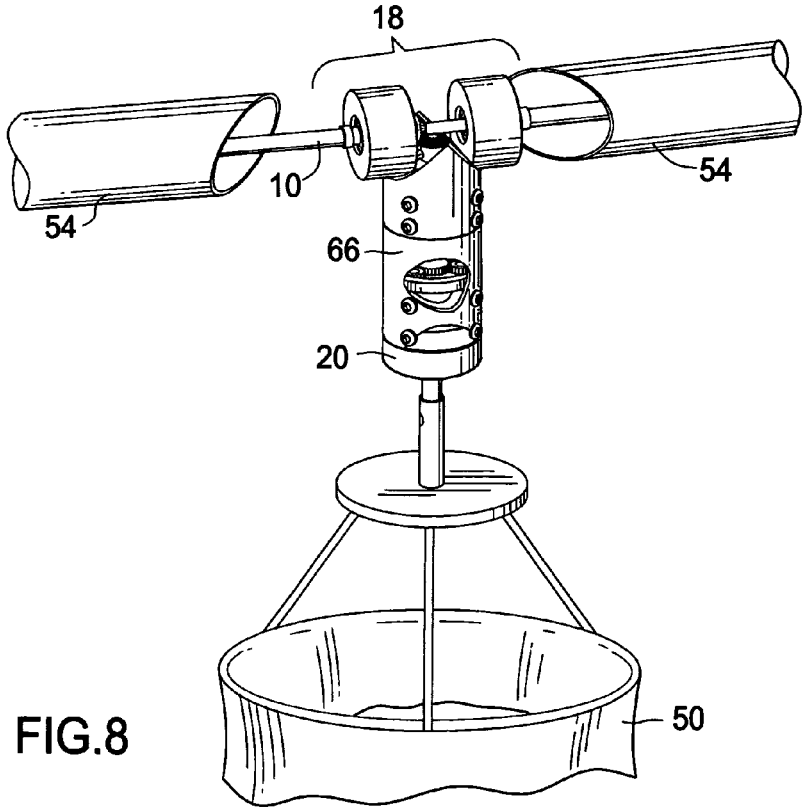
FIG. 8 is a detailed diagram illustrating how one of the miter gear coupling tee assemblies is employed to drive one of the rotating elements of the display structure of FIG. 5.
Figure 11:
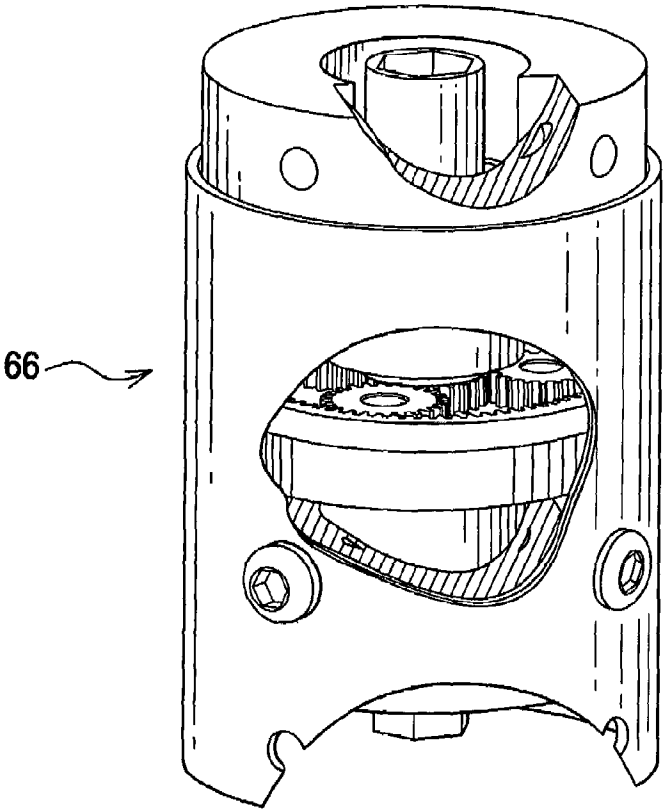
FIG. 11 is a detailed cutaway pictorial diagram of a speed reducer that may be employed in the display structures of FIGS. 1 and 5.

A drive motor 64, which may be the same as drive motor 14 of FIG. 2, is installed within base 44, preferably in axial alignment with one of the support tubes 56. A drive shaft 59 is coupled to motor 64 and positioned for rotation within the one of support tubes 56 that is axially aligned with motor 64. A drive shaft 10 is positioned for rotation within circular tube 54 in the same way as drive shaft 10 of FIG. 1 is positioned within support tube 22 of FIG. 1. The rotational motion imparted to drive shaft 59 by motor 64 is coupled to drive shaft 10 by one of the previously-described coupling tee assemblies 18, as illustrated in FIG. 7. Each of the attraction elements 48, 50 is in turn rotationally driven from drive shaft 10 by employing another one of the coupling tee assemblies 18, as illustrated in FIG. 8. If it is desired to reduce the rotational speed at which one or more of the attraction elements 48, 50 is driven, a speed reducer 66 may be employed, as also illustrated in FIG. 8. The conventional geared speed reduction mechanism utilized in speed reducer 66 is detailed in FIG. 11. Also illustrated in FIG. 8 is one of the carrier assemblies 20, described above, coupled between speed reducer 66 and attraction element 50.

Figure 10:
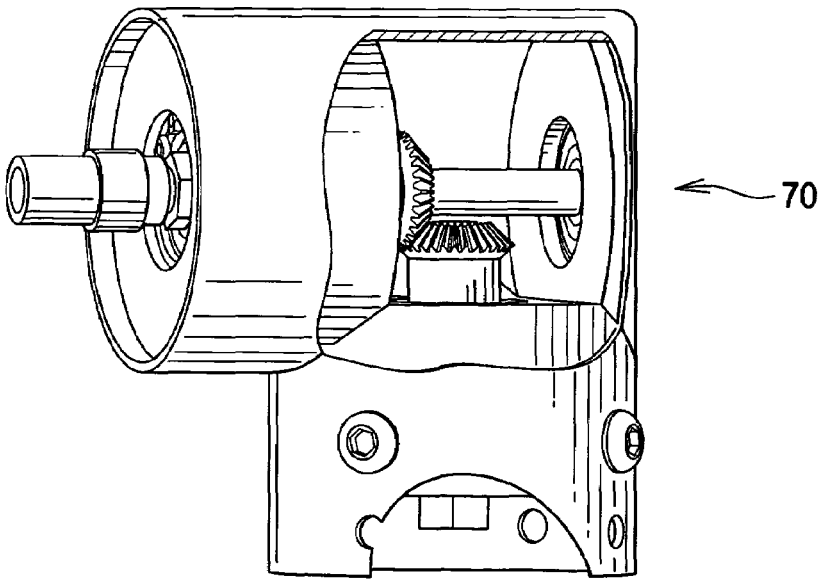
FIG. 10 is a detailed cutaway pictorial diagram of a 90-degree drive train coupler that may be employed in a display structure in accordance with the present invention.
Figure 12:
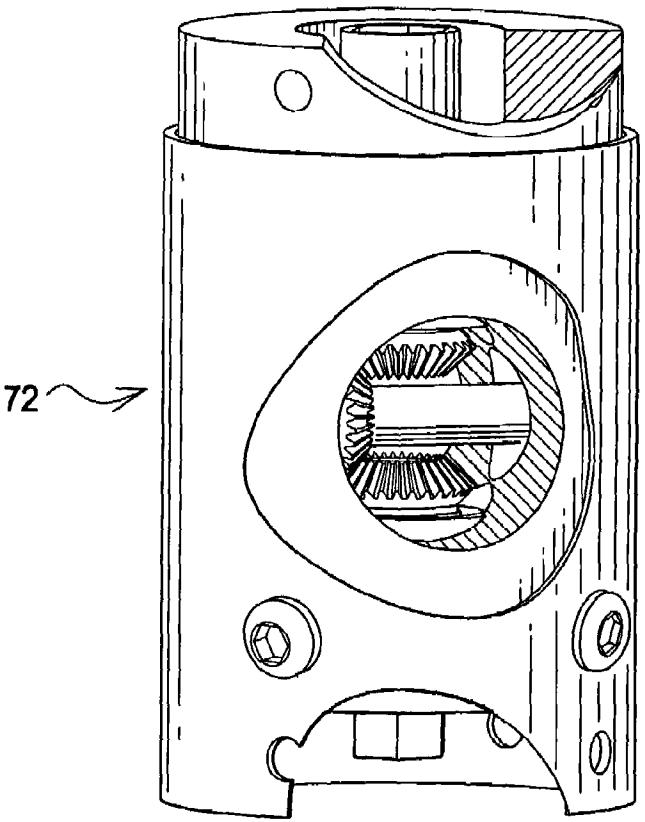
FIG. 12 is a detailed cutaway pictorial diagram of a direction reverser that may be employed in the display structures of FIGS. 1 and 5.

In addition to the coupling tee assemblies 18 detailed in FIGS. 2-4 and 7-9, it may be desirable to employ other rotational drive train coupling assemblies in connection with different display configurations that utilize the principles of the present invention. Representative of such coupling assemblies are the 90-degree coupler 70 illustrated in FIG. 10, the speed reducer 66 of FIG. 11, and the direction reverser 72 illustrated in FIG. 12. All of these drive train coupler assemblies utilize well known mechanical gearing arrangements, typical of which are those illustrated.

I claim:

1. A ring banner tension fabric display structure adapted to be hung from an attachment point above the structure, comprising:

an upper circular support tube positioned horizontally, said upper circular support tube comprising a plurality of arcuate segments coupled together;

a lower circular support tube positioned horizontally below said upper support tube, said lower circular support tube comprising a plurality of arcuate segments coupled together;

a plurality of generally vertical structural members connected between said upper and lower circular support tubes for maintaining said upper and lower circular support tubes in a fixed, parallel relationship;

a flexible segmented drive shaft supported for rotation within said upper circular support tube;

a drive motor coupled to said drive shaft for imparting rotational motion to said drive shaft;

a fabric membrane attached along an outer periphery of said upper and lower circular support tubes to form a cylindrical membrane banner, said fabric membrane banner having a plurality of spaced apart openings therein;

a plurality of attraction elements, each positioned in a selected one of said openings in said fabric membrane, each of said attraction elements being suspended for rotation from said upper circular support tube; and means coupled to said drive shaft and to each one of said plurality of attraction elements for rotationally driving each of said attraction elements.

2. A display structure as in claim 1 further comprising a plurality of spaced apart circular discs attached within said upper support tube, each of said circular discs having a central opening therein for receiving said drive shaft and supporting said drive shaft for rotation therein.

3. A display structure as in claim 1 further comprising a 90-degree drive transfer element coupled to said drive motor and to said drive shaft for transferring rotational motion of an output shaft of said drive motor to said drive shaft.

4. A display structure as in claim 3 wherein said drive transfer element comprises a miter gear coupling tee assembly.

5. A display structure as in claim 1 wherein said means coupled to said drive shaft and to each one of said plurality of attraction elements comprises a 90-degree miter gear coupling tee assembly.

6. A display structure as in claim 1 wherein one or more of said means coupled to said drive shaft and to each one of said plurality of attraction elements comprises a speed reducer for rotationally driving a corresponding one or more of said attraction elements at a speed lower than a rotational speed of said drive shaft.

7. A display structure as in claim 1 wherein one or more of said means coupled to said drive shaft and to each one of said plurality of attraction elements comprises a direction reverser for rotationally driving a corresponding one or more of said attraction elements in a reverse direction.

8. A display structure as in claim 1 further comprising a carrier assembly coupled between each of said attraction elements and said upper circular support tube for transferring the weight of each of said attraction elements to said upper circular support tube.

9. A free-standing display structure comprising:

a base;

a plurality of segmented upwardly and outwardly curved support tubes;

an upper circular support tube horizontally positioned and attached at a top end of each of said plurality of upwardly and outwardly curved support tubes;

a fabric membrane attached outside said plurality of upwardly and outwardly curved support tubes to define an upwardly and outwardly extending conical form;

a drive motor mounted in said base;

a first flexible segmented drive shaft supported for rotation within a selected one of said plurality of upwardly and outwardly curved support tubes and coupled to said drive motor for rotationally driving said first drive shaft;

a second flexible segmented drive shaft supported for rotation within said upper circular support tube;

a plurality of attraction elements, each of which is suspended for rotation from said upper circular support tube; and a plurality of drive transfer elements, each coupled to said second drive shaft and to each one of said plurality of attraction elements for rotationally driving each of said attraction elements.

10. A display structure as in claim 9 further comprising:

a plurality of spaced apart circular discs attached within said selected one of said upwardly and outwardly curved support tubes for receiving said first drive shaft and for supporting said first drive shaft for rotation therein; and a plurality of spaced apart circular discs attached within said upper circular support tube for receiving said second drive shaft and for supporting said second drive shaft for rotation therein.

11. A display structure as in claim 9 wherein said drive motor is mounted in axial alignment with said first drive shaft for directly driving said first drive shaft.

12. A display structure as in claim 9 wherein each of said drive transfer elements comprises a 90-degree miter gear coupling tee assembly.

13. A display structure as in claim 9 wherein one or more of said drive transfer elements comprises a speed reducer for rotationally driving a corresponding one or more of said attraction elements at a speed lower than a rotational speed of said second drive shaft.

14. A display structure as in claim 9 wherein one or more of said drive transfer elements comprises a direction reverser for rotationally driving a corresponding one or more of said attraction elements in a reverse direction.

15. A display structure as in claim 9 further comprising a carrier assembly coupled between each of said attraction elements and said upper circular support tube for transferring the weight of each of said attraction elements to said upper circular support tube.

* * * * *